United States Patent [19]

Cuschera

[11] 4,412,361

[45] Nov. 1, 1983

[54] BUTTON ACTUATED POP UP DRAIN FITTING

[76] Inventor: Casper Cuschera, 800 Durham Rd., Fremont, Calif. 94538

[21] Appl. No.: 330,718

[22] Filed: Dec. 14, 1981

[51] Int. Cl.[3] ..... A47K 1/14

[52] U.S. Cl. ..... 4/286; 4/287; 4/295

[58] Field of Search ..... 4/286, 287, 290, 293, 4/291, 292, 295; 285/323; 403/370, 367, 374

[56] References Cited

U.S. PATENT DOCUMENTS

| | | | |
|---|---|---|---|
| 3,366,980 | 2/1968 | Patursson et al. | 4/295 |
| 3,428,295 | 2/1969 | Downey et al. | 4/295 |
| 3,468,512 | 9/1969 | Politz | 4/295 X |
| 3,771,177 | 11/1973 | Rogers et al. | 4/287 |
| 3,995,333 | 12/1976 | Stephens | 4/286 |
| 4,006,498 | 2/1977 | Cuschera | 4/286 |
| 4,007,500 | 2/1977 | Thompson et al. | 4/295 |
| 4,103,372 | 8/1978 | Cuschera | 4/287 X |
| 4,144,599 | 3/1979 | Cuschera | 4/287 |
| 4,339,832 | 7/1982 | Cuschera | 4/286 X |
| 4,369,531 | 1/1983 | Swanson | 4/295 |

*Primary Examiner*—Henry K. Artis

*Attorney, Agent, or Firm*—Harris Zimmerman; Howard Cohen

[57] ABSTRACT

A selectively sealable drain fitting includes a tubular drain body having a spider in the lower end thereof. An upwardly extending rectangular post is joined to the center of the spider, and is provided with a lateral slot in one face thereof and an oblique camming surface directly superjacent thereto. A drain sealing cover is provided with a downwardly depending hollow tubular portion which is received about the rectangular post and maintained in an eccentric disposition thereabout by an eccentric lip extending laterally from the upper end of the post. A latch pin extending laterally through the tubular portion of the cover engages the camming surface and the slot in the post in detent fashion. A button actuator extends upwardly from the center of the cover, and is connected to an arm which is slidably disposed within a slot in the bore of the tubular member. The drain fitting is sealed by urging the cover downwardly so that the latch pin is engaged by the slot. The cover is released by pushing the button in the cover to translate the arm and release the latch pin from the slot.

5 Claims, 5 Drawing Figures

BUTTON ACTUATED POP UP DRAIN FITTING

BACKGROUND OF THE INVENTION

The following U.S. Pat. Nos. exemplify the state of the art of selectively self-sealing drain valves: 4,103,372, 3,771,177, 3,428,295, 3,380,081, 3,366,980, 2,173,529.

It is well known in the art to provide sealable drain fittings, particularly in domestic use for bathtubs, sinks, and the like. These drains are generally provided with a remote actuator which is linked to the drain itself by a lever or chain arrangement. Over a period of years, these drains and the lever or chain linkages undergo erosion and wear, and eventually fail. Due to the fact that the linkage is usually located within a wall or beneath a bathtub or sink, it is usually quite difficult to gain access to the linkage for the purpose of making repairs. Because of the expense and trouble involved in such repairs, a homeowner often avoids such costs by providing a replacement sealable drain valve which does not require a remote actuator.

Generally speaking, these replacement drain valves may be installed in the body of the original drain valve, and often include a drain cover which translates axially to seal the top opening of the replacement valve. The prior art devices are resiliently biased to the upwardly extending, open position by means of resilient rubber sleeves or by helical compression springs. The devices generally include a latch detent mechanism which secures the drain cover in a closed position in opposition to the resilient force applied thereto. In these devices, to release the drain cover it is necessary to press a small edge portion thereof to disengage the latch. For the uninitiated and uninformed, it is an inconvenience to attempt to determine which portion of the cover must be pressed to open the drain valve. This situation may be exacerbated when the drain cover is obscured from view by the water which is retained thereby.

SUMMARY OF THE PRESENT INVENTION

The present invention generally comprises a selectively sealable drain valve which may be operated with greater ease than those known in the prior art. Its most salient feature is that it provides a button actuator extending axially upwardly from the drain cover to release the drain cover from the sealed position by manual pressure applied to the button. Due to the fact that the button may be located and actuated easily without being directly viewed, the present invention provides a drain valve which is much easier to open than its predecessors in the prior art.

The selectively sealable drain valve includes a tubular drain body having a spider in the lower end thereof. An upwardly extending rectangular post is joined to the center of the spider, and is provided with a lateral slot in one face thereof and an oblique camming surface directly superjacent thereto. A drain sealing cover is provided with a downwardly depending hollow tubular portion of which is received about the rectangular post and maintained in an eccentric disposition thereabout by an eccentric lip extending laterally from the upper end of the post. A latch pin extending laterally through the tubular portion of the cover engages the camming surface and the slot in the post in detent fashion. A button actuator extends upwardly from the center of the cover, and is connected to an arm which is slidably disposed within a slot in the bore of the tubular member. The drain fitting is sealed by urging the cover downwardly so that the latch pin is engaged by the slot. The cover is released by pushing the button in the cover to translate the arm and release the latch pin from the slot.

DESCRIPTION OF THE PREFERRED EMBODIMENT

Figure 3:
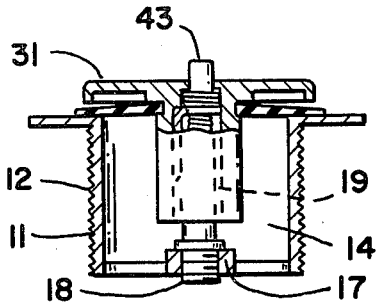
FIG. 3 is a partially sectioned elevation of the drain valve of the present invention, shown in the closed position.

The selectively sealable drain valve of the present invention generally includes a tubular body member 11 which is provided with external threads 12. The member 11 includes an axially disposed bore 14 extending therethrough, and a radially outwardly extending flange protruding from the upper end of the body member 11. At the lower end of the member 11 there is secured a spider 16 spanning the bore 14 and supporting an axially disposed ring 17. The ring 17 is provided with a concentrically extending threaded hole, as shown in FIG. 3.

Figure 1:
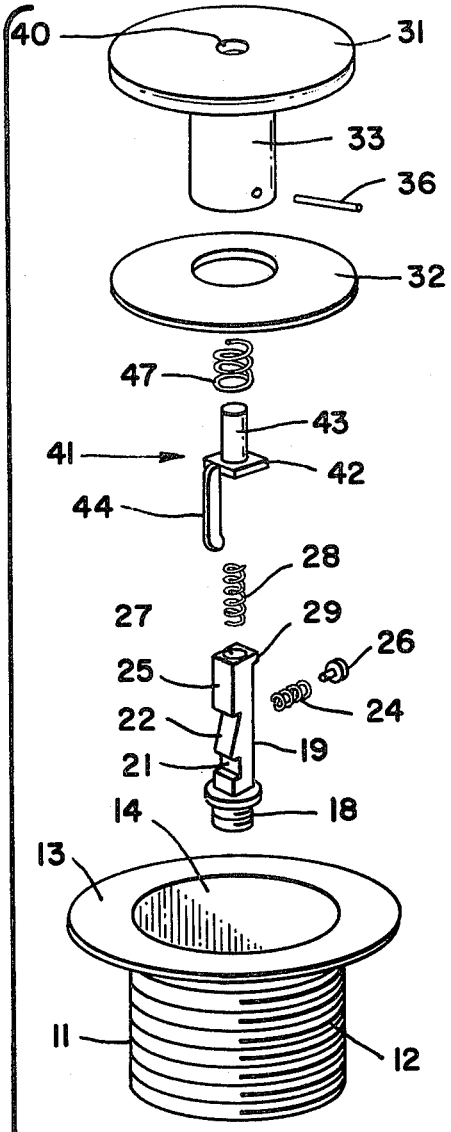
FIG. 1 is an exploded view of the selectively sealable drain valve of the present invention.
Figure 2:
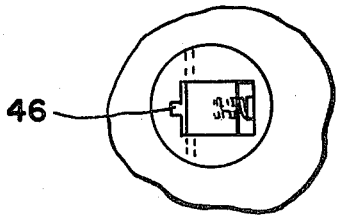
FIG. 2 is a laterally cross-sectional, detail view of the rectangular post and tubular member of the present invention.

The drain valve also includes a generally rectangular post 19 which includes a lower threaded end 18 adapted to be secured in the threaded hole of the ring 17. One vertical surface 25 of the rectangular post 19 is provided with a laterally extending detent slot 21. The same vertical surface is also provided with a ramped, camming surface 22 extending from the upper lip of the slot 21 upwardly and obliquely inwardly, as shown in FIG. 1.

Figure 4:
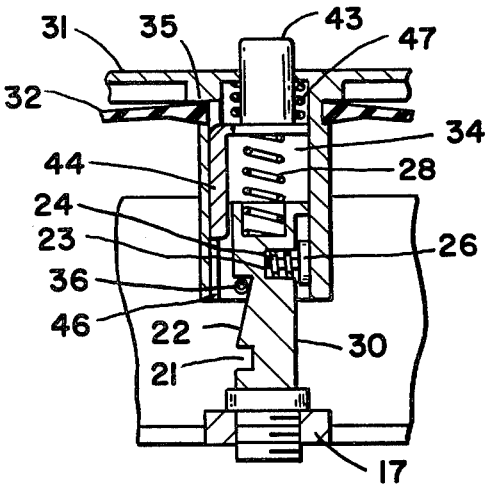
FIG. 4 is a cross-sectional elevation of the central portion of the present invention, shown in the open disposition.
Figure 5:
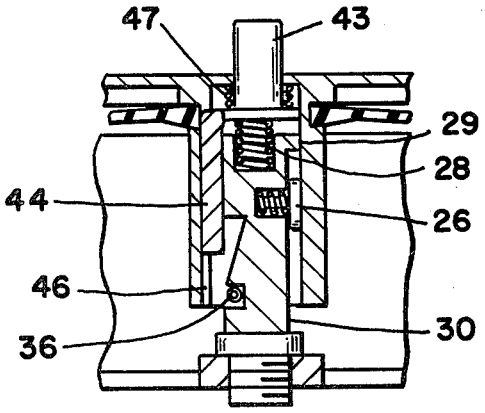
FIG. 5 is a cross-sectional elevation of the central portion of the present invention, shown in the closed disposition.

The vertical surface 30 of the rectangular post, which is diametrically opposed to the vertical surface 25, is provided with a radially extending hole 23. Disposed in the hole 23 is a helical compression spring 24, and a flat head biasing member 26. The spring 24 biases the member 26 radially outwardly, for reasons which will be explained in the following description. Extending from the upper end of the surface 30 is a lip 29. As shown in FIGS. 1, 4, and 5, the lip 29 extends laterally outwardly only from the surface 30.

Disposed in the top of the rectangular post 19 is an axially extending bore 27. Seated in the bore 27 is a helical compression spring 28, which extends upwardly from the rectangular post. The function of the spring 28 will be made apparent in the following description.

The drain valve of the present invention also includes a generally disk-like drain cover 31. Extending downwardly from the drain cover and disposed concentrically with the axis thereof is a tubular member 33. The outer surface of the tubular member 33 is provided with a reduced diameter annulus 35, shown in FIGS. 4 and 5. An annular sealing gasket 32 is resiliently secured in the annulus 35, with the peripheral portion thereof angled slightly downwardly with respect to the cover 31. The outer diameter of the gasket 32 is greater than the diameter of the bore 14 of the drain valve body member, and the peripheral edge of the gasket is adapted to impinge upon the flange 13 in sealing fashion to prevent any flow through the bore 14 of the drain valve.

As shown in FIGS. 3, 4, and 5, the tubular member 33 is provided with a rectangular bore 34 extending axially therein. The drain cover 31 includes an axially disposed hole 40 extending therethrough and communicating with the bore 34. The bore 34 is adapted to receive the rectangular post 19. The width of the post from side 25 to side 30 is less than the diameter of the bore 34, and the tubular portion 33 is disposed parallel to the post 19 and laterally offset therefrom. The lip 29 extending from the side 30 of the post maintains the lateral offset of the tubular portion 33, and the spring biased member 26 maintains the tubular portion in generally parallel alignment with the axis of the post 19.

The bore 34 is also provided with a longitudinally extending rectangular groove 46 extending the length thereof. Received within the bore 34 is an actuator member 41, as shown in FIGS. 1, 4, and 5. The actuator member 41 includes a rectangular base 42, a button actuator 43 extending axially upwardly therefrom, and an arm 44 extending downwardly from an edge portion of the member 42. The arm 44 is dimensioned so that the entire length of the outer edge thereof is received within the groove 46 of the bore 34. The button actuator 43 is dimensioned to extend freely through the hole 40 of the drain cover 31. A helical compression spring 47 is adapted to be secured about the proximal end of the button actuator 43 within the upper extent of the bore 34. The actuator member 41 is disposed in freely translating fashion within the bore 34 and the groove 46. As shown in FIGS. 1, 4, and 5, the lower end of the arm 44 is slightly enlarged in its lateral width dimension.

A lateral pin 36 is also provided in the lower end of the tubular member 33, extending along a cord through the bore 34. The latch pin 36 is disposed adjacent to the camming surface 22, and is adapted to be retained in the detent slot 21, as shown in FIG. 5. It may be understood that the compression of the springs 28 and 47 biases the cover 31 upwardly, so that the gasket 32 clears the flange 13 of the drain valve body by a substantial margin. In this configuration, shown in FIG. 4, there is free flow through the gap defined by the gasket 32 and the flange 13. To close the drain valve and prevent fluid flow through the bore 14, the cover member is manually urged downwardly by pressure applied directly above the tubular member 33, or to a portion of the cover along a radius thereof opposed to lip 29. As the cover is depressed, the tubular member 33 and the actuator member 41 are urged downwardly, compressing the springs 28 and 47. At the same time, the latch pin 36 rides the camming surface 22, causing the tubular member 33 to pivot slightly about the lip 29 and urge the member 26 into its hole 23 against the resilient force of the spring 24. As the latch pin 26 reaches the detent slot 21, the resilient urging of the spring 24 causes the latch pin to enter the slot 21, as shown in FIG. 5, locking the cover in the depressed position. The action of the spring 24 also causes the tubular member to regain its parallel alignment with the rectangular post 19. In this disposition, shown in FIG. 3, the peripheral rim of the gasket 32 impinges upon the flange 13. Thus the valve is sealed against any flow through the bore 14. It may be appreciated that any pressure loading due to liquid accumulating above the valve will merely increase the sealing action of the gasket 32.

To release the drain valve from the closed position shown in FIG. 5, the button 43 of the member 41 is urged manually in a downward direction to cause the member 41 to translate downwardly within the bore 34. This action also causes the arm 44 to translate downwardly in the groove 46. When the enlarged lower end of the arm 44 impinges upon the lower end of the camming surface 22, the lower end of the tubular member 33 is urged outwardly to pivot about the lip 29. This action releases the pin 36 from the slot 21. The expansive forces of the springs 28 and 47 then urge the cover member upwardly, opening the valve and allowing flow therethrough. The upward travel of the cover member is limited by the impingement of the latch pin 36 and the ledge defined by the upper extent of the camming surface 22, as shown in FIG. 4. It should be noted that the button actuator 41 is easily located by manual touch, even when the drain valve itself is submerged and obscured from view. Thus the present invention provides an actuator which is easier to use than those known in the prior art.

I claim:

1. In a drain valve including a drain body having a flow channel therethrough and a post extending axially through said flow channel, and a drain sealing cover provided with a tubular portion having a central passage receiving said post for slidable translation thereabout and radial clearance therefrom, detent means in one axially extending surface of said post for selectively securing said post and said tubular portion with said drain sealing cover sealing said flow channel, and resilient means for biasing said cover upwardly to the open position, the improvement comprising button actuator means for releasing said detent means, said button actuator means including a button extending upwardly from said drain sealing cover and adapted to be manually depressed to release said detent means, said central passage comprising a rectangular bore extending axially in said tubular portion, and a rectangular groove formed in one wall of said rectangular bore, said button being disposed generally within said bore, said drain sealing cover including a hole extending therethrough to said rectangular bore, said button extending upwardly from said button actuator means and through said hole, said button actuator means further including an arm extending generally downwardly from and edge portion thereof, said arm being slidably received in said rectangular groove.

2. The drain valve of claim 1, further including a first compression spring secured about the proximal end of said button and disposed within said rectangular bore.

3. The drain valve of claim 2, further including a second compression spring secured to the upper end of said post and disposed to impinge upwardly on the lower end of said button actuator member.

4. The drain valve of claim 1, wherein said arm includes an enlarged lower end adapted for engaging and releasing said detent means.

5. The drain valve of claim 4, wherein said detent means includes a pin extending fixedly through said rectangular bore and releasably engaging a slot in said post, and said lower end of said arm is disposed to translate along said groove and impinge upon said post to urge said pin out of said slot and release said drain cover.

* * * * *